US006029561A

United States Patent [19]

Näslund et al.

[11] Patent Number: 6,029,561

[45] Date of Patent: Feb. 29, 2000

[54] FLUID PRESSURE CYLINDER

[75] Inventors: Peter Näslund, Stockholm; Bo G. Disbo, Skärholmen, both of Sweden

[73] Assignee: AB Rexroth Mecman, Stockholm, Sweden

[21] Appl. No.: 08/947,082

[22] Filed: Oct. 8, 1997

[30] Foreign Application Priority Data

Oct. 15, 1996 [SE] Sweden ..... 9603774

[51] Int. Cl.[7] ..... F15B 15/22

[52] U.S. Cl. ..... 91/394; 91/408; 92/165 PR; 92/168

[58] Field of Search ..... 91/394, 395, 407, 91/408; 92/165 PR, 168

[56] References Cited

U.S. PATENT DOCUMENTS

| | | | |
|---|---|---|---|
| 3,027,877 | 4/1962 | Lansky | 91/394 |
| 3,067,726 | 12/1962 | Williams | 91/395 |
| 3,528,339 | 9/1970 | Darnell | 91/394 |
| 3,559,540 | 2/1971 | Sheldon . | |
| 4,111,100 | 9/1978 | Boyer | 92/165 PR |
| 4,312,264 | 1/1982 | Nunnemacher et al. . | |
| 4,638,717 | 1/1987 | Carr | 91/395 |
| 5,471,909 | 12/1995 | Kobelt . | |

FOREIGN PATENT DOCUMENTS 0471073 2/1992 European Pat. Off. .

*Primary Examiner*—F. Daniel Lopez
*Attorney, Agent, or Firm*—Townsend and Townsend and Crew LLP

[57] ABSTRACT

A fluid pressure cylinder (1) includes two cylinder end walls (6',6"), a cylinder tube (2) and a piston (3), which is axially movable inside the cylinder tube, wherein at least one of the cylinder end walls is provided with an outward housing portion (7;60) and, located therein, an inward insert portion (8;61) which comprises a portion of at least one fluid channel belonging to the cylinder. The cylinder is distinguished in that the housing portion axially contacts the cylinder tube under force transmission, and that the insert portion includes an integral valve seat (12,16,22") of a fluid valve which is located in said fluid channel.

19 Claims, 2 Drawing Sheets

17
12
18
16

63
26
61
62

33
22''
61

27'
61
63
62

33
22'

26
22'
17
61
18

8
29
63
62

FLUID PRESSURE CYLINDER

BACKGROUND OF THE INVENTION

This invention concerns a fluid pressure cylinder.

In previously known devices of this kind having end walls including pressure fluid valves therein the end wall is manufactured in one piece which makes it necessary to produce a detail having relatively considerable material thickness. This means that the work-piece for the cylinder end wall has to be subjected to machining in order to avoid cavities in the material resulting from forming, such as e.g. die-casting. Machining such as drilling, milling and facing operations lead to increased costs for the detail and consequently for the entire resulting pressure cylinder. Also the housing of a valve which is positioned in the end wall demands different kinds of machining operations.

A fluid pressure cylinder having the cylinder end wall divided into an insert portion and a cap portion is previously known from U.S. Pat. No. 5,471,909, wherein the cap portion also includes holding means for mounting the cylinder on a part of machinery. This known cylinder, however, does not include any valve inside the cylinder end wall and the coupling between the cylinder end walls and the cylinder tube is obtained by tension rods which tighten the cap portions so as to press the insert portion against the cylinder end wall. This means that the insert portion must be dimensioned for transmitting the corresponding forces.

It is a aim of this invention to provide a fluid pressure cylinder of the above mentioned kind wherein the said disadvantages are eliminated.

SUMMARY OF THE INVENTION

This way it is achieved that the parts of the cylinder end wall may be formed optimal with respect to each part and with such material thickness and such manufacturing methods that machining of the separate parts will be substantially unnecessary. By the axial contact of the housing portion against the cylinder tube the force will be transmitted between these two parts which allows the insert portion to be manufactured without demands for force resistance which would be related to such force transmission. By the insert portion having an integral valve seat, essential advantages with respect to manufacture are achieved. As an example it could be mentioned that the valve seat may be formed already in the forming process whereby no particular machining operation what so ever will be necessary.

All together it is achieved that a cylinder end wall according to the invention may be manufactured rationally with a minimum of machining which brings about a work-saving and economically advantageous solution.

Different preferred valve embodiments, which are included in the cylinder end wall according to the invention are discussed below.

The sealing member may be placed between the housing portion and the insert portion.

The recess is preferably formed already in the process of forming the insert portion in order to provide a rotation prevented piston.

Preferred materials for forming the housing portion and the insert portion of the cylinder end wall include an aluminum alloy and a polyamide, respectively. These materials have been found particularly suitable and rendering the parts producable with a minimum of machining.

A support ring may be used for co-operation with the cylinder end wall parts.

The invention may include a piston having a cushion sleeve and a cylinder end wall having a cushion sleeve recess. The invention is particularly applicable in cylinders of this kind since the dimensions-of the cylinder end wall increases in correspondence with the length of the cushion sleeve/cushion sleeve recess. In correspondence thereto the dimensions of a conventional workpiece for the manufacture of a conventional cylinder end wall would also increase, accentuating the above problems. These additional problems are solved by the insert portion also including the cushion sleeve recess.

BRIEF DESCRIPTION OF THE DRAWINGS

The invention will now be described closer by way of examples and referring to the annexed drawings, wherein.

DESCRIPTION OF A PREFERRED EMBODIMENT

Figure 1:
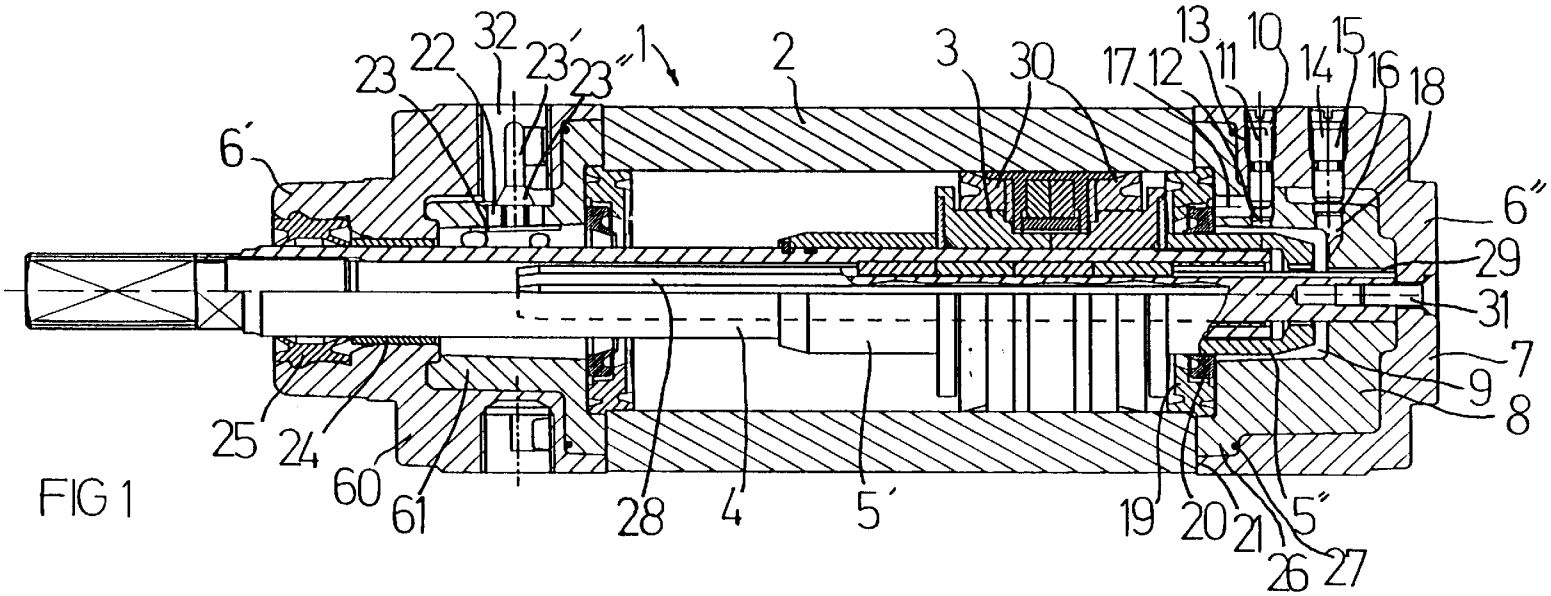
FIG. 1 shows a fluid pressure cylinder according to the invention in an axial section.

The fluid pressure cylinder of FIG. 1 is generally indicated 1. The fluid pressure cylinder 1 includes a cylinder tube 2 and a piston 3 moveable therein and provided with a piston rod 4 and two cushion sleeves 5' and 5". 6' indicates the cylinder end wall located at the piston rod side and 6" the opposite cylinder end wall. The cylinder end wall 6" includes an outer housing portion 7 and, fixed therein, an insert portion 8 which comprises a cushion sleeve recess 9 for the co-operation with the cushion sleeve 5". A cushion channel portion 17 leads to the cushion sleeve recess 9 and includes a valve seat 12 for a cushion valve 10 which is located in the end wall. The cushion valve 10 further comprises a valve element 11, comprised of a screw, which co-operates with threads 13 in a hole in the housing portion 7, said hole in the assembled state being in line with the valve seat 12 of the insert portion. The cushion valve works in a per see previously known manner and is active when the cushion sleeve enters the cushion sleeve recess, which constitutes the forming of a cushion chamber in the cylinder. The cushioning function is thus conventional and will therefore not be further described.

Further the insert portion 8 comprises an exhaust channel potion 18 which includes a valve seat 16 for co-operation with a screw valve element 15 belonging to a speed regulating valve 14.

A support ring 19 for a cushion seal 20 is in a per see known way arranged between the cylinder tube 2 and the end wall 6". From the Figure it is clear that the housing portion 7 comprises an axial contact surface 21 which co-operates with the cylinder tube 2 and which constitutes a force transmitting surface between these parts. The insert portion 8 is thus squeezed between on the one hand the housing portion and on the other hand the cylinder end wall 2 and the support ring 19.

There is, however, no force transmission worth mentioning through the insert portion, which means that this part does not have to be dimensioned according thereto. The support ring also functions as a seal between the cylinder tube and the insert portion.

22 indicates generally an inlet channel valve which includes holes (22' in FIG. 4) in the insert portion 8 and 61, here shown at 61, and a flexible valve membrane 23 for the co-operation with said holes and contacting the inner surface of the cushion sleeve recess. This construction very simply provides a one way valve for the inlet channel. The valve membrane is further provided with a central pin 23', which is provided with a snap flange 23" for the co-operation with a corresponding hole (33 in FIG. 5) in the insert portion.

Further, on the piston rod side 30, the housing portion 60 is provided with a piston rod guide 24 and a combined seal and wiper element 25.

For sealing between the housing portion 7 and the insert portion 8 the latter is provided with a groove at 27 on a surrounding flange portion 26 for receiving a correspondingly shaped seal 27. This seal prevents leakage at the contact surface 21.

Figures 3, 3A, 4, 4A, 5, 6, 7:
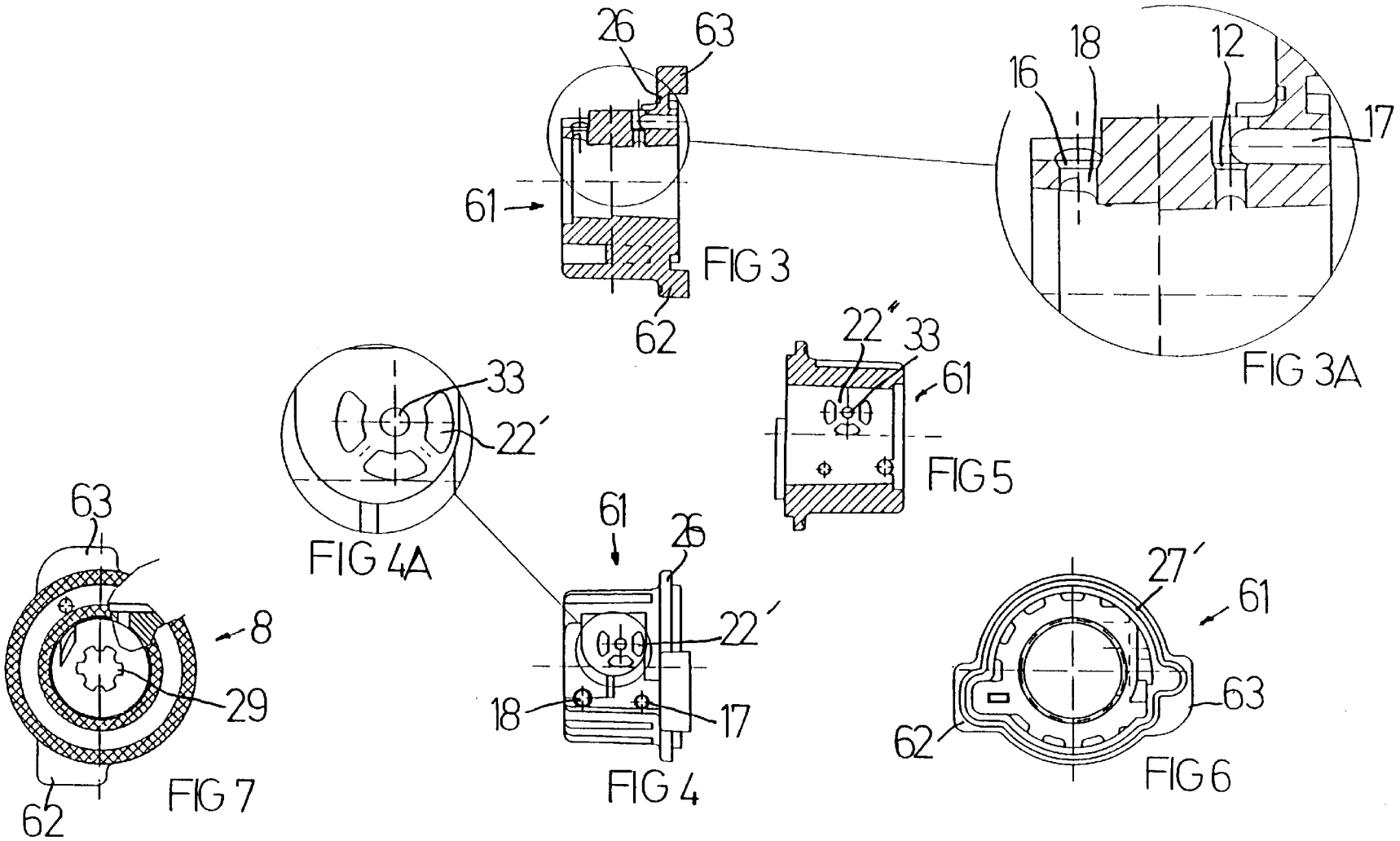
FIG. 3 shows an insert portion for the piston rod side of a fluid pressure cylinder according to FIG. 1 in an axial section.
FIG. 3A shows in a partial enlargement the insert portion of FIG. 3.
FIG. 4 shows the insert portion of FIG. 3 in a view from above as seen in FIG. 1.
FIG. 4A shows in a partial enlargement the insert portion of FIG. 4.
FIG. 5 shows the insert portion of FIG. 3 in another axial section.
FIG. 6 shows the left insert portion of FIG. 1 seen in the direction from the left in the same Figure.
FIG. 7 shows the right insert portion of FIG. 1 seen in the direction from the left in the same Figure.

In order to prevent rotation of the piston, and thereby the piston rod with respect to the cylinder, the device is provided with a rotation preventing rod 28 which co-operates with corresponding means in the piston in order to prevent rotation but allow axial movement. The rod 28 is fastened axially in the housing portion 7 by the screw 31, and further the insert portion 8 also is centrally provided with a recess 29 for co-operation with the rod 28 so as to prevent rotation, see here particularly FIG. 7 showing the recess or hole 29. In the embodiment of FIG. 1 the rod 28 is provided with splines and the hole 29 in FIG. 7 with corresponding splines in the insert portion 8.

Figure 2:
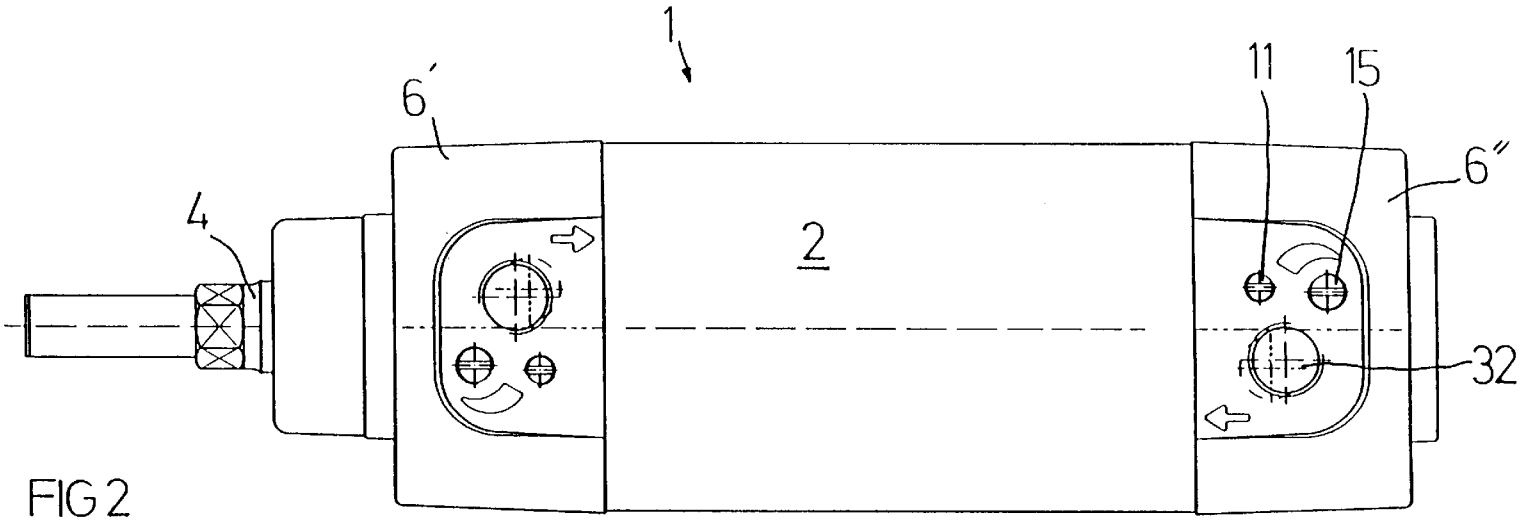
FIG. 2 shows the fluid pressure cylinder of FIG. 1 in a side view.

FIG. 2 shows the fluid pressure cylinder 1 in an assembled condition with cylinder end walls 6' and 6", the cylinder tube 2 and the piston rod 4. On the outside of the cylinder end walls there are shown the screw valve means 11 of the cushion valve, the screw valve element 15 of the speed regulating valve and the pressure fluid connection 32. As seen from this Figure the fluid pressure cylinder according to the invention forms a clean and smooth construction having the capacity of fulfilling high purity demands for the application i.a. in the food industry.

FIG. 3 and FIG. 3A show the insert portion of FIG. 1 of the piston rod side of the cylinder whereby for example the fluid channel portions and the flange portion 26 are shown. 62 and 63 indicate positioning lugs for assuring adequate positioning of the insert portion 61 with respect to the housing portion 7. Corresponding elements are arranged on the insert portion 8.

From FIG. 3A the cushion channel portion 17 is shown in more detail and the valve seat 12 located therein. Further the exhaust channel portion 18 is shown and the valve seat 16 located therein. These seats are designed in a per se known manner for co-operation with screw regulating valve elements.

FIG. 4 and FIG. 4A show the channel portions 17 and 18 as well as 22' belonging to the inlet channel valve 22 of the insert portion 61. FIG. 4A shows in more detail the shapes of the holes 22', distributed essentially circular around the hole 33 which is adapted for co-operation with the pin 23' of the flexible valve membrane as has been described above.

FIG. 5 shows the insert portion 61 in section and also the holes 22' and 33'. The surface 22' shown here in the region around these holes is the inside surface of the cushion sleeve recess and is, as was mentioned above, adapted for co-operation with the flexible valve membrane in order to form the inlet channel valve 22 and thus to form the seat of this valve.

FIG. 6 shows the flange portion 26 of the insert portion 61 seen in the direction from the left in FIG. 1 showing the recess 27', which receives the previously described seal 27 for sealing co-operation with the corresponding housing portion of the cylinder end wall.

The invention is not limited to the above described embodiment but only by the annexed claims. Thus, within the scoop of the invention, are cylinder end walls having insert portions comprising one or more valve seats even if the described is the most preferred embodiment wherein the gain of the invention is particularly pronounced. In such a cylinder according to the invention and according to this embodiment fluid pressure cylinders are obtained having all valves which may be necessary for several applications simply integrated in the respective cylinder end wall.

Other materials than the ones stated may come into question whereby for example also the insert portion may be made of metal.

We claim:

1. Fluid pressure cylinder (1) including two cylinder end walls (6', 6"), a cylinder tube (2) and a piston (3), which is axially movable inside the cylinder tube, wherein at least one of the cylinder end walls is provided with an outward housing portion (7;60) and, located therein, an inward insert portion (8;61) which comprises a portion of at least one fluid channel belonging to the cylinder, characterized in that the housing portion axially contacts the cylinder tube under force transmission, that the insert portion includes an integral valve seat (12, 16, 22") of a fluid valve which is located in said fluid channel, that the portion of the at least one fluid inlet channel includes a one way valve (22), and that the insert portion comprises a recess (9) having an inward surface and the one way valve is comprised of a flexible valve membrane (23) which contacts the inward surface of the recess (9).

2. Cylinder according to any of previously claims, characterized in that the insert portion includes a portion (18) of an exhaust fluid channel.

3. Cylinder according to claim 2, characterized in that the exhaust channel portion in the insert portion includes a valve seat (16) for co-operation with a piston speed regulating valve element (15).

4. Cylinder according to claim 3, characterized in that said valve element is comprised of a screw valve element (15) co-operating with threads in the housing portion.

5. Cylinder according to any of the previous claims, characterized in that the insert portion includes a cushion channel portion (17).

6. Cylinder according to claim 5, characterized in that the cushion channel of the insert portion is provided with a valve seat (12) for co-operation with a cushioning regulating valve element (11).

7. Cylinder according to claim 6, characterized in that said valve element is comprised of a screw valve element (11) which co-operates with threads in the housing portion.

8. Cylinder according to any of the previous claims, characterized in that the insert portion (8) includes a radially extending flange portion (26), which is provided with a sealing surface (27, 27') cooperating with the housing portion.

9. Cylinder according to claim 8, characterized in that said sealing surface is provided with a surrounding axially directed recess (27') for receiving an elastic seal element (27).

10. Cylinder according to claim 1 wherein said one of said cylinder end walls does not have a piston rod lead through, characterized in that the insert portion (8) is provided with a central recess (29) for rotation preventing co-operation with a stationary rod (28), preventing rotation of the piston (3).

11. Cylinder according to claim 1, characterized in that the insert portion includes an axial end position stop for the piston.

12. Cylinder according to claim 1, characterized in that the housing portion (7) is manufactured from an aluminum alloy.

13. Cylinder according to claim 1, characterized in that the insert portion (8) is manufactured from a polyamide.

14. Cylinder according to claim 1, characterized in that a support ring (19) is arranged between the end wall and the cylinder tube so as to hold the insert portion inside the housing portion, form a seat of a cushion seal (20) and seal between the cylinder tube and the insert portion.

15. Cylinder according to claim 1 wherein at least one of said cylinder end walls comprises an exhaust channel, and wherein the piston is provided with at least one cushion sleeve (5', 5") for sealing the exhaust channel in a continued movement and for the formation of cushion chamber, characterized in that the insert portion includes a cushion sleeve recess (9) so as to allow it to receive said cushion sleeve.

16. Cylinder according to any of the previous claims, characterized in that the housing portion and the insert portion are provided with meeting surfaces which are shaped for relative positioning in a rotational direction.

17. Fluid pressure cylinder (1) including two cylinder end walls (6', 6"), a cylinder tube (2) and a piston (3), which is axially movable inside the cylinder tube, wherein at least one of the cylinder end walls is provided with an outward housing portion (7;60) and, located therein, an inward insert portion (8;61) which comprises a portion of at least one fluid channel belonging to the cylinder, characterized in that the housing portion axially contacts the cylinder tube under force transmission, that the insert portion includes an integral valve seat (12, 16, 22") of a fluid valve which is located in said fluid channel, that the insert portion includes a portion (18) of an exhaust fluid channel, that the exhaust channel portion in the insert portion includes a valve seat (16) for co-operation with a piston speed regulating valve element (15), and that said valve element is comprised of a screw valve element (15) co-operating with threads in the housing portion.

18. Fluid pressure cylinder (1) including two cylinder end walls (6', 6"), a cylinder tube (2) and a piston (3), which is axially movable inside the cylinder tube, wherein at least one of the cylinder end walls is provided with an outward housing portion (7;60) and, located therein, an inward insert portion (8;61) which comprises a portion of at least one fluid channel belonging to the cylinder, characterized in that the housing portion axially contacts the cylinder tube under force transmission, that the insert portion includes an integral valve seat (12, 16, 22") of a fluid valve which is located in said fluid channel, that the insert portion includes a cushion channel portion (17), that the cushion channel of the insert portion is provided with a valve seat (12) for co-operation with a cushioning regulating valve element (11), and that said valve element is comprised of a screw valve element (11) which co-operates with threads in the housing portion.

19. Fluid pressure cylinder (1) including two cylinder end walls (6', 6"), a cylinder tube (2) and a piston (3), which is axially movable inside the cylinder tube, wherein at least one of the cylinder end walls is provided with an outward housing portion (7;60) and, located therein, an inward insert portion (8;61) which comprises a portion of at least one fluid channel belonging to the cylinder, characterized in that the housing portion axially contacts the cylinder tube under force transmission, that the insert portion includes an integral valve seat (12, 16, 22") of a fluid valve which is located in said fluid channel, and that a support ring (19) is arranged between the end wall and the cylinder tube so as to hold the insert portion inside the housing portion, form a seat of a cushion seal (20) and seal between the cylinder tube and the insert portion.

* * * * *